US007814712B2

(12) United States Patent
Tsai

(10) Patent No.: US 7,814,712 B2
(45) Date of Patent: Oct. 19, 2010

(54) SHOCK SUPPRESSOR

(76) Inventor: Chong-Shien Tsai, 6F-2, No. 5, Lane 466, Minchuan Rd., North Dist., Taichung (TW)

( * ) Notice: Subject to any disclaimer, the term of this patent is extended or adjusted under 35 U.S.C. 154(b) by 223 days.

(21) Appl. No.: 11/986,049

(22) Filed: Nov. 20, 2007

(65) Prior Publication Data

US 2008/0120927 A1 May 29, 2008

(30) Foreign Application Priority Data

Nov. 28, 2006 (TW) ..... 95143957 A

(51) Int. Cl.
*E04H 9/00* (2006.01)
*E04B 1/98* (2006.01)

(52) U.S. Cl. ..... 52/167.4; 52/1; 52/167.1; 248/636

(58) Field of Classification Search ..... 52/1, 52/167.1, 167.4–167.7; 248/636
See application file for complete search history.

(56) References Cited

U.S. PATENT DOCUMENTS 2,014,643 A * 9/1935 Bakker ..... 384/49
2,359,036 A * 9/1944 Harper ..... 296/35.1
4,320,549 A * 3/1982 Greb ..... 14/73.5
5,056,280 A * 10/1991 Shustov ..... 52/167.5
6,085,473 A * 7/2000 Teramachi et al. ..... 52/167.5
6,164,022 A * 12/2000 Ishikawa et al. ..... 52/167.5
6,321,492 B1 * 11/2001 Robinson ..... 52/167.1
6,505,806 B1 * 1/2003 Glaesener ..... 248/638
6,631,593 B2 * 10/2003 Kim ..... 52/167.9
6,688,051 B2 * 2/2004 Tsai ..... 52/167.4
6,725,612 B2 * 4/2004 Kim ..... 52/167.5
6,820,380 B2 * 11/2004 Tsai ..... 52/167.4
6,862,849 B2 * 3/2005 Kim ..... 52/167.9
7,237,364 B2 * 7/2007 Tsai ..... 52/167.6
2002/0166296 A1 * 11/2002 Kim ..... 52/167.5
2006/0000159 A1 * 1/2006 Tsai ..... 52/167.4
2006/0048462 A1 * 3/2006 Huang et al. ..... 52/167.5
2007/0130848 A1 * 6/2007 Tsai ..... 52/167.7
2007/0157532 A1 * 7/2007 Tsai ..... 52/167.1
2008/0078633 A1 * 4/2008 Tsai ..... 188/266
2008/0098671 A1 * 5/2008 Tsai ..... 52/167.6

* cited by examiner

*Primary Examiner*—Richard E Chilcot, Jr.
*Assistant Examiner*—Elizabeth A Plummer
(74) *Attorney, Agent, or Firm*—Jackson Walker, LLP

(57) ABSTRACT

A shock suppressor has a first base, a second base, a sliding holder assembly and a connecting device. The first base has an elongated first sliding channel in a first direction. The second base is parallel to the first base and has an elongated second sliding channel in a second direction. The connecting device is slidably mounted between the first and second sliding channels. The sliding holder assembly is mounted between the connecting device and at least one of the bases. The first base is connected with one of the convex ends of the connecting device in a curved contact surface to provide a first sliding mechanism in a first unidirectional sliding direction. The second base is connected with the other convex end of the connecting device to provide a second sliding mechanism in a second unidirectional sliding direction.

17 Claims, 13 Drawing Sheets

SHOCK SUPPRESSOR

BACKGROUND OF THE INVENTION

1. Field of the Invention

The present invention relates to a shock suppressor for a building, a bridge or a motion sensitive equipment, and more particularly to a shock suppressor that can dissipate seismic shock energy in both horizontal and vertical directions efficiently.

2. Description of Related Art

With the decrease of construction area, heights of buildings become higher and higher, so effect of ground motions is very important factors to be considered in the design of a building, a bridge or a skyscraper. Therefore, shock reduction is very important aspect in a construction, and shock suppressors are widely used in a building, a bridge or a skyscraper. Additionally, to improve precision of sophisticated machines, shock suppressors are also applied to the machines.

A conventional shock suppressor is provided to dissipate shock energy and substantially comprises a top base, a bottom base and a slider. The bases are attached respectively to a construction and the ground, and the slider may be a ball and is held slidably between the bases. With the sliding movement of the slider relative to the bases, shock energy generated by earthquake can be isolated and dissipated.

However, the conventional shock suppressor can only dissipate shock energy in a horizontal direction, but does not efficiently dissipate shock energy in vertical or multiple directions.

To overcome the shortcomings, the present invention tends to provide a shock suppressor to mitigate or obviate the aforementioned problems.

SUMMARY OF THE INVENTION

The main objective of the invention is to provide a shock suppressor that can dissipate seismic shock energy in both horizontal and vertical directions efficiently. The shock suppressor has a first base, a second base, a sliding holder assembly and a connecting device. The first base has an elongated first sliding channel in a first direction, and the first sliding channel has a concave surface. The second base is parallel to the first base and has an elongated second sliding channel defined in a side facing the first base in a second direction. The second sliding channel has a concave surface facing the first base. The connecting device is slidably mounted between the first and second sliding channels in the first and second bases to connect the first and second bases and has two convex ends. The sliding holder assembly is mounted between the connecting device and at least one of the bases. The first base is connected with one of the convex ends of the connecting device in a curved contact surface to provide a first sliding mechanism in a first unidirectional sliding direction. The second base is connected with the other convex end of the connecting device to provide a second sliding mechanism in a second unidirectional sliding direction.

Other objects, advantages and novel features of the invention will become more apparent from the following detailed description when taken in conjunction with the accompanying drawings.

BRIEF DESCRIPTION OF THF DRAWINGS

DETAILED DESCRIPTION OF PREFERRED EMBODIMENT

Figure 1:
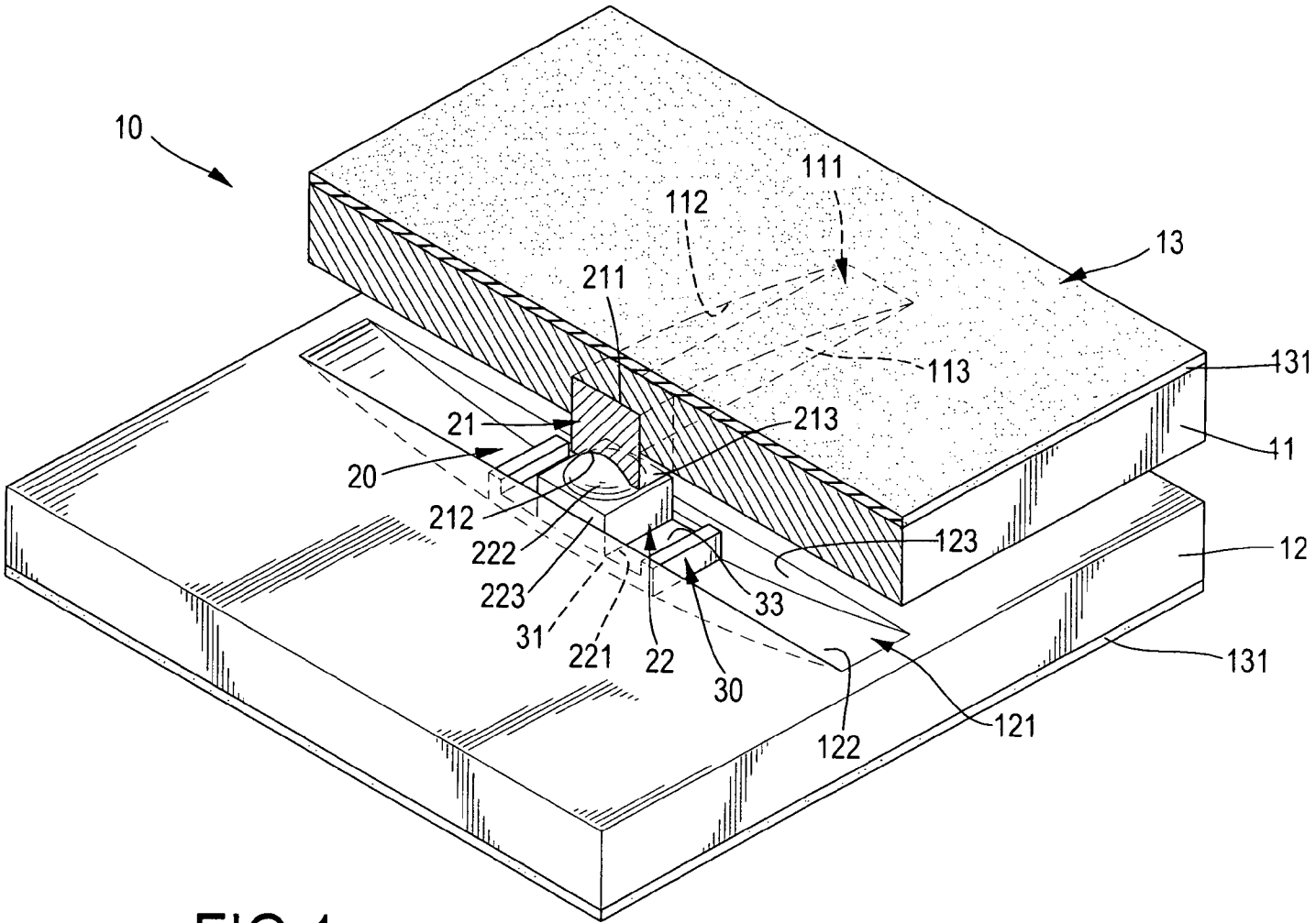
FIG. 1 is a perspective view in partial cross section of a first embodiment of a shock suppressor in accordance with the present invention.
Figure 2:
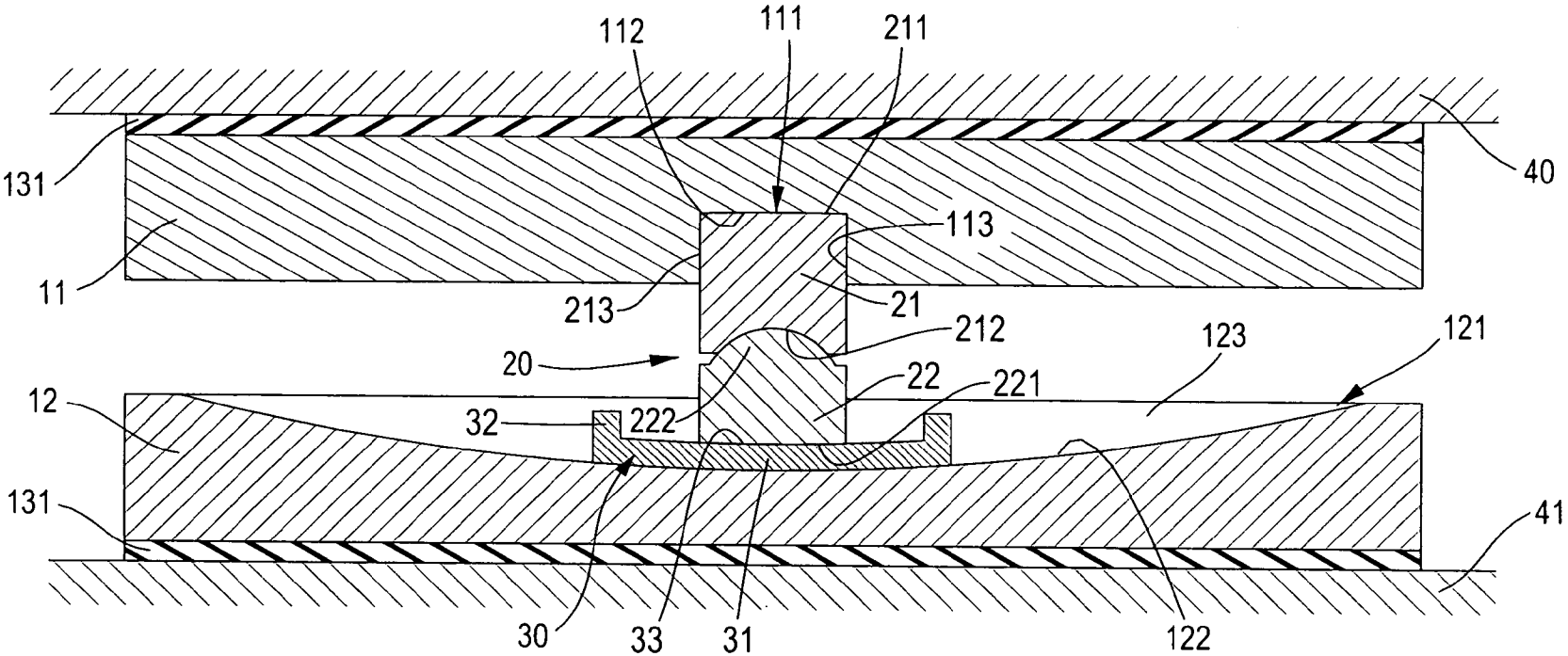
FIG. 2 is a cross sectional side view of the shock suppressor in FIG. 1.

With reference to FIGS. 1 and 2, a shock suppressor (10) in accordance with the present invention can be applied between a construction (40), such as a building, a bridge or an instrument and the ground (41) and comprises a first base (11), a second base (12), a sliding holder assembly (30), a connecting device (20) and a damping device (13).

The second base (12) is parallel to the first base (11). The connecting device (20) is slidably mounted between the first base (11) and second base (12) to connect the first and second bases (11,12). The first base (11) is connected with the connecting device (20) in curved contact surfaces to provide a first sliding mechanism in a first unidirectional sliding direction. The second base (12) is connected with the connecting device (20) to provide a second sliding mechanism in a second unidirectional sliding direction preferably perpendicular to the first unidirectional direction. The sliding holder (31) is mounted slidably in one of the bases (11,12).

A damping device (13) is mounted on at least one of the first base (11), the second base (12) and the connecting device (20). The damping device (13) can be made of resilient rubber material, viscoelastic material, frictional material or material with an excellent damping coefficient.

In the first embodiment of a shock suppressor in accordance with the present invention, the first base (11) has an elongated first sliding channel (111) defined in a side facing the second base (12) along a first direction. The first sliding channel (111) has a concave surface (112) facing the second base (12) and two guiding sides (113) facing to and being parallel to each other.

The second base (12) has an elongated second sliding channel (121) defined in a side facing the first base (11) along a second direction different from but preferably perpendicular to the first direction. The second sliding channel (121) has a concave surface (122) facing the first base (11) and two guiding sides (123) facing to and being parallel to each other.

The damping device (13) comprises two damping pads (131) attached respectively to the first and second bases (11, 12).

The sliding holder assembly (30) comprises a single sliding holder (31) mounted slidably in the second sliding channel (121) in the second base (12) and has a convex bottom abutting and matching with the concave surface (122) in the second sliding channel (121). A recess (33) with a concave bottom is defined in the sliding holder (31) at a side facing the first base (11) to form two limiting flanges (32) respectively at two ends of the sliding holder (31). The sliding holder (31) further has two guiding sides respectively abutting against the guiding sides (123) of the second sliding channel (121).

The connecting device (20) comprises a first slider (21), a second slider (22) and a universal connector. The first slider (21) has a facing end facing to the second slider (22) and a convex end (211). The convex end (211) is formed on the first slider (21) at an end opposite to the facing end and abuts and matches with the concave surface (112) in the first sliding channel (111). The first slider (21) further has two guiding sides (213) respectively abutting against the guiding sides (113) of the first sliding channel (111).

The second slider (22) has a facing end facing to the first slider (21) and a convex end (221) formed on the second slider (22) at an end opposite to the facing end and abutting and matching with the concave bottom of the recess (33) in the sliding holder (31). The second slider (22) further has two guiding sides (223) respectively abutting against the guiding sides (123) of the second sliding channel (121).

The universal connector is mounted between the first slider (21) and the second slider (22) and comprises a recess (212) and a supporting member (222). The recess (212) is defined in the facing end of the first slider (21), and the supporting member (222) is formed on the facing end of the second slider (22) and is rotatably mounted in the recess (212) in the first slider (21). In the first embodiment, the supporting member (222) is a convex protrusion formed on the facing end of the second slider (22) and rotatably held in the recess (212) in the first slider (21), and the recess (212) and the supporting member (222) are hemispherical.

With the concave surface (112) in the first sliding channel (111) and the convex end (211) on the first slider (21) of the connecting device (20), the first sliding mechanism between the first base (11) and the connecting device (20) in a first unidirectional sliding direction is achieved.

With the concave surface (122) of the second sliding channel (121), the convex bottom of the sliding holder (31), the concave bottom of the recess (33) and the convex end (221) on the second slider (22) of the connecting device (20), the second sliding mechanism between the second base (12) and the connecting device (20) in a second unidirectional sliding direction is achieved.

In such an arrangement, the connecting device (20) can provide an excellent supporting effect to the supported structures including buildings, bridges, etc. before a shock occurring. When a shock occurs, the second base (12) will move relative to the first base (11). With the arrangements of the sliding mechanisms between the bases (11,12), the sliding holder (31) and the connecting device (20) and the damping device (13), the shock energy can be efficiently isolated, dissipated, eliminated, suppressed or absorbed in both horizontal and vertical directions.

When the shock has stopped, the first and second bases (11,12) will automatically move to an original position with the concave and convex surfaces in the bases (11,12), the sliding holder (31) and the connecting device (20), such that the shock suppressor has an automatic positioning effect to an original status.

Figure 3:
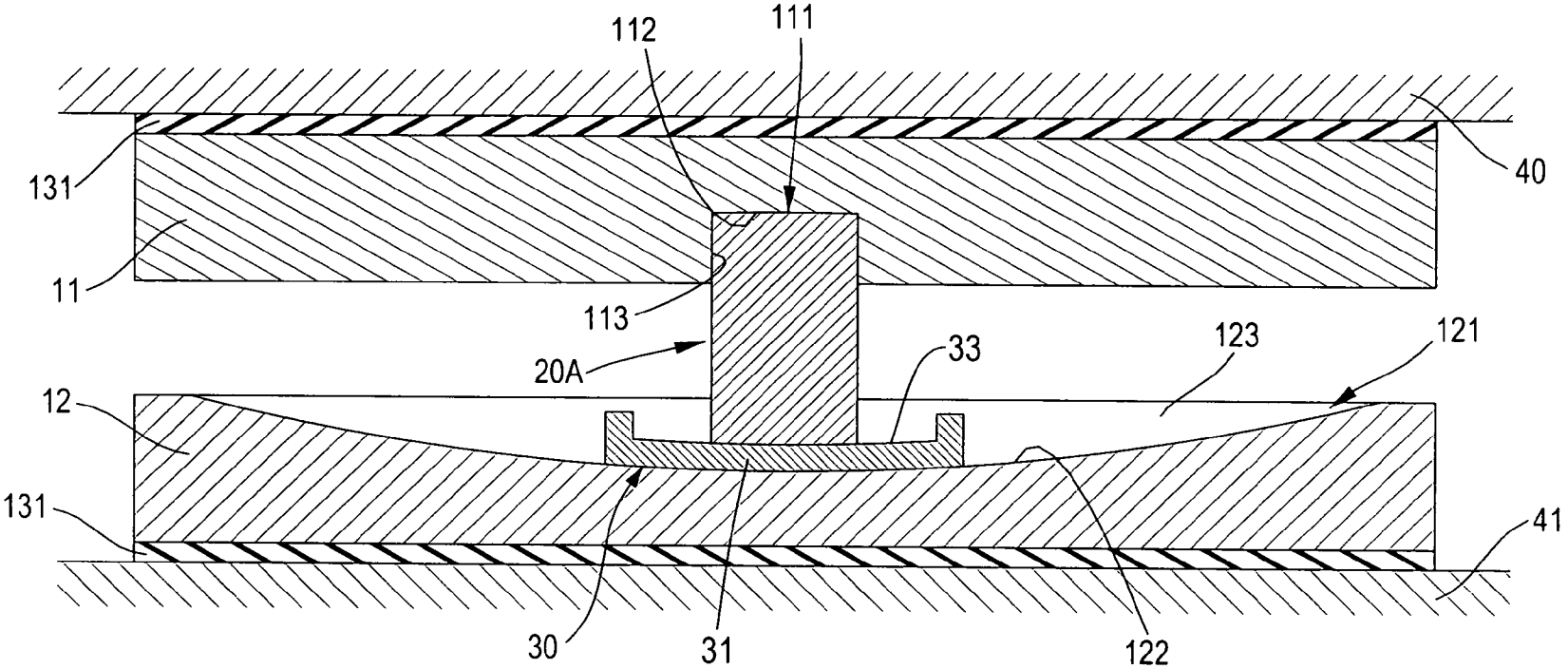
FIG. 3 is a cross sectional side view of a second embodiment of a shock suppressor in accordance with the present invention.

With reference to FIG. 3, in a second embodiment of the shock suppressor, the connecting device (20A) may be a rod having two convex ends abutting and matching respectively with the concave surface (112) in the first sliding channel (111) and the concave bottom in the recess (33) of the sliding holder (31).

Figure 4:
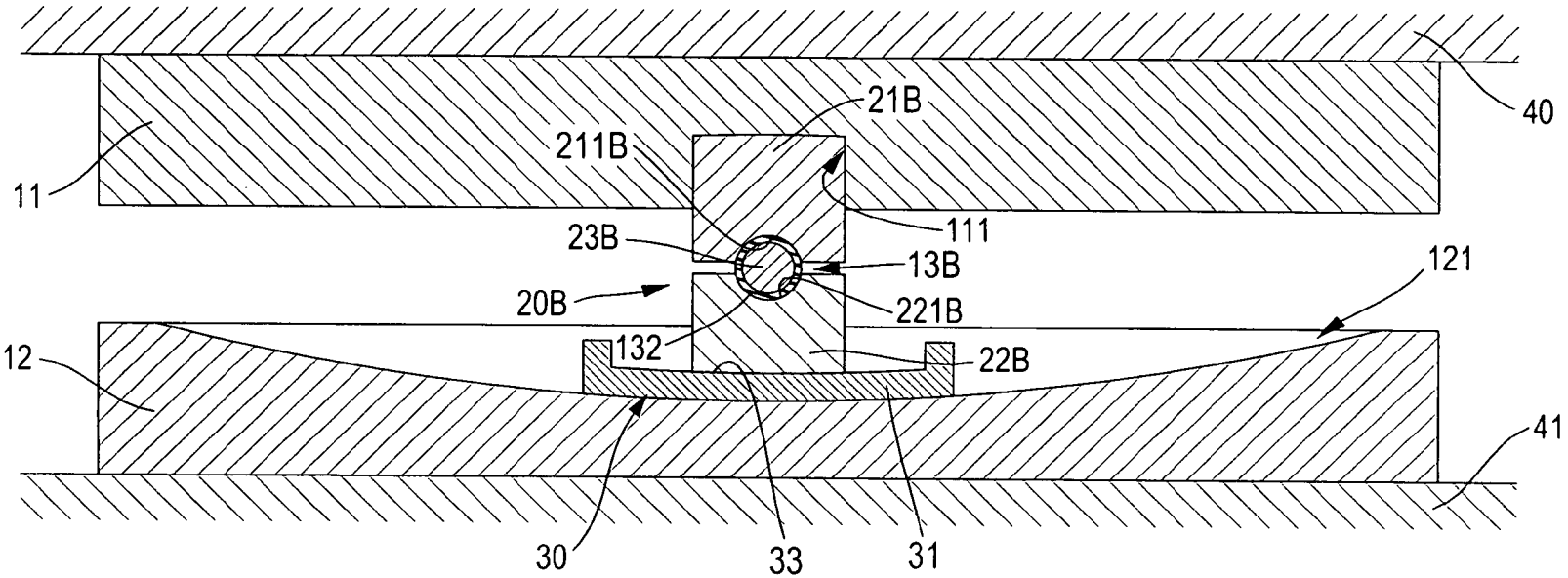
FIG. 4 is a cross sectional side view of a third embodiment of a shock suppressor in accordance with the present invention.

With reference to FIG. 4, a third embodiment of the shock suppressor has a structure substantially same as that in the first embodiment except that the universal connector of the connecting device (20B) comprises two recesses (211B, 221B) and a supporting member (23B). The recesses (211B, 221B) are defined respectively in the facing ends of the first slider (21B) and the second slider (22B). The supporting member (23B) is rotatably mounted in the recesses (211B, 221B) in the first and second sliders (21B,22B). In the third embodiment, the recesses (211B,221B) in the first and second sliders (21B,22B) are hemispherical, and the supporting member (23B) is spherical. The damping device (13B) comprises a damping pad (132) mounted around the spherical supporting member (23B).

Figure 5:
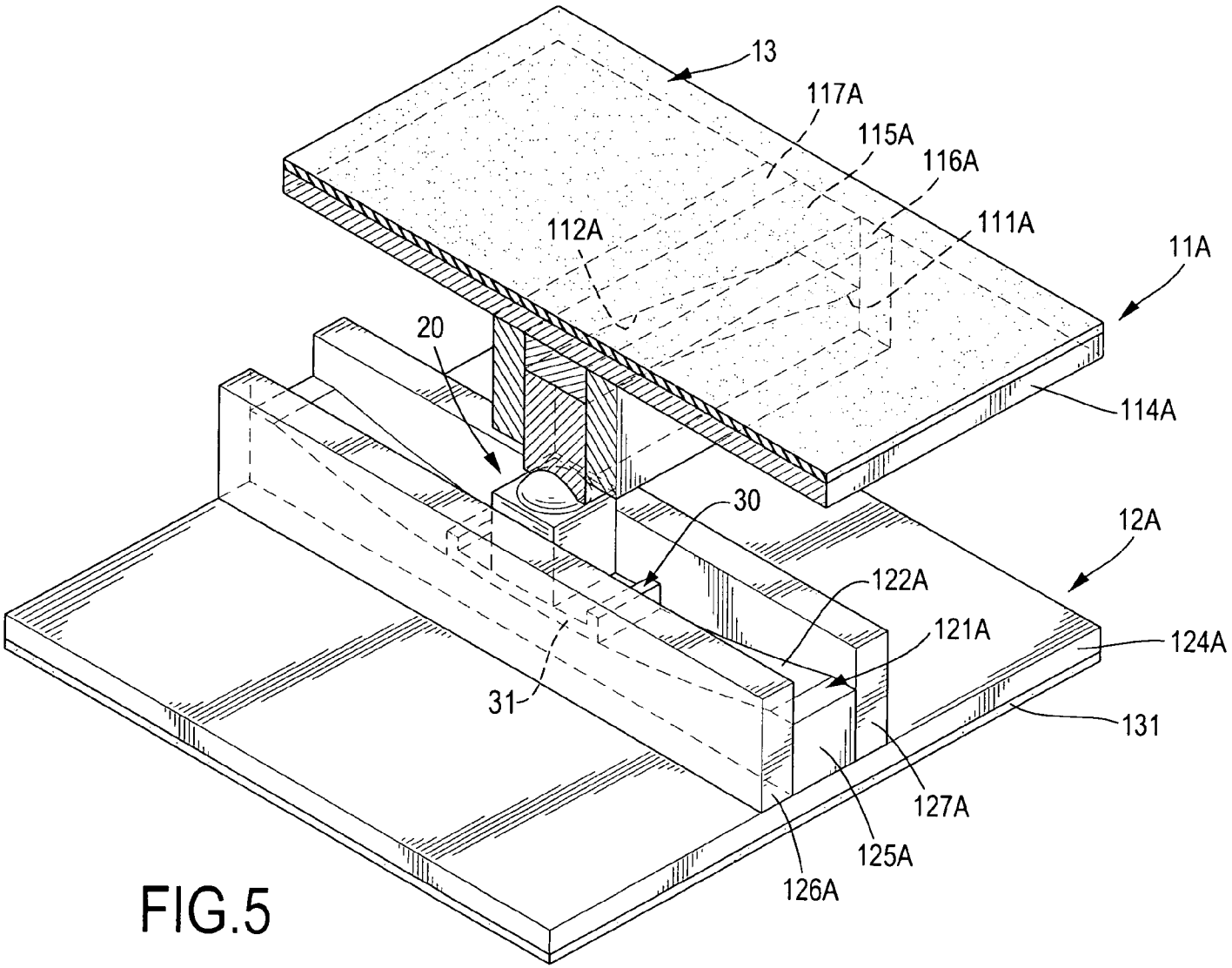
FIG. 5 is a perspective view in partial cross section of a fourth embodiment of a shock suppressor in accordance with the present invention.

With reference to FIG. 5, in a fourth embodiment of the shock suppressor, the first base (11A) has two parallel side plates (116A,117A) formed on and extending from the side facing the second base (12A) and a guiding block (115A) mounted between the side plates (116A,117A) to define the first sliding channel (111A) between the side plates (116A, 117A) and the guiding block (115A). The guiding block (115A) has a concave surface (112A) facing the second base (12A) and corresponding to and matching with the convex end on the connecting device (20).

The second base (12A) has two parallel side plates (126A, 127A) formed on and extending from the side facing the first base (11A) and a guiding block (125A) mounted between the side plates (126A,127A) to define the sliding channel (121A) between the side plates (126A,127A) and the guiding block (125A). The guiding block (125A) has a concave surface (122A) facing the first base (11A) and corresponding to and matching with the convex bottom on the sliding holder (31).

Figure 6:
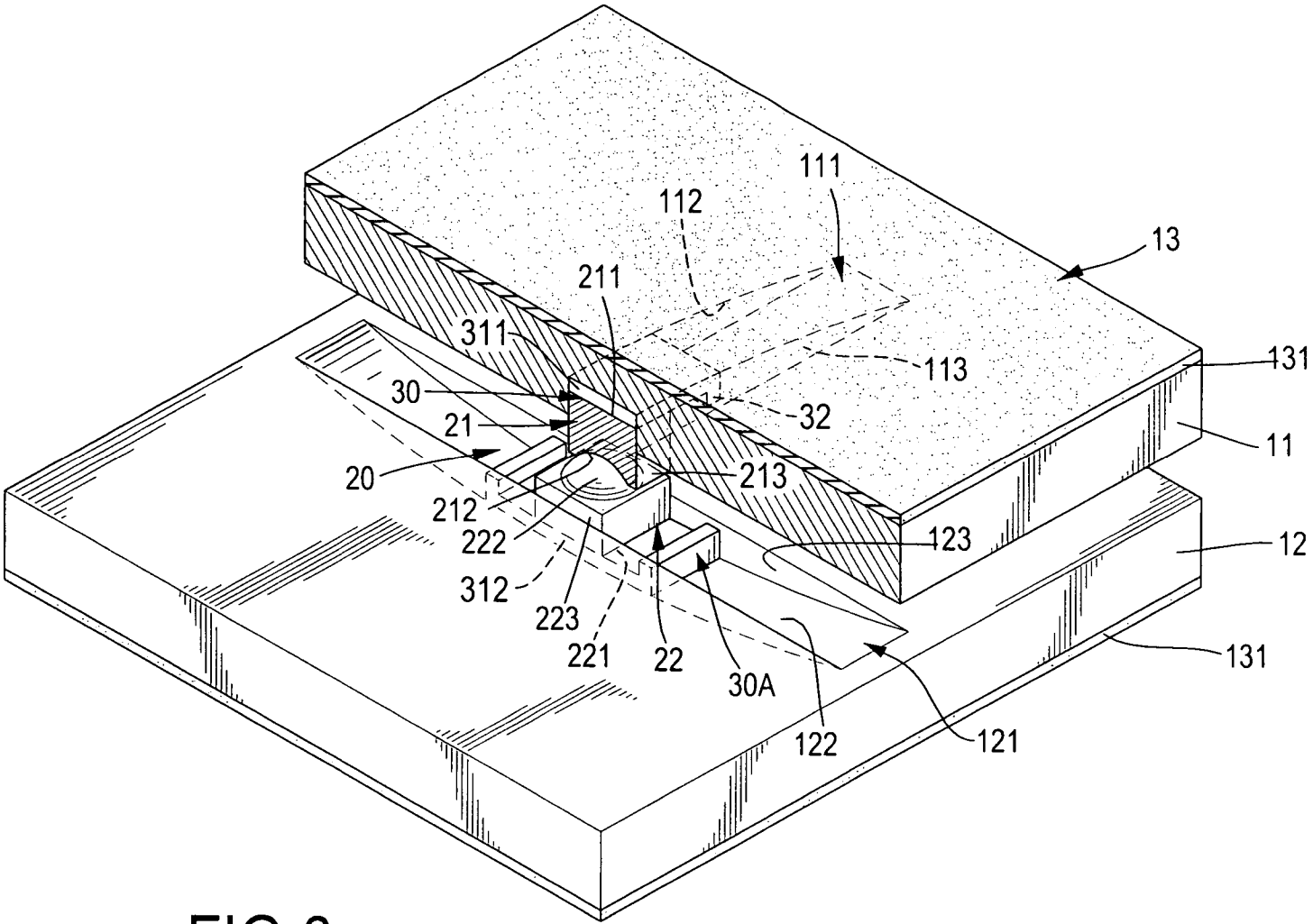
FIG. 6 is a perspective view in partial cross section of a fifth embodiment of a shock suppressor in accordance with the present invention.
Figure 7:
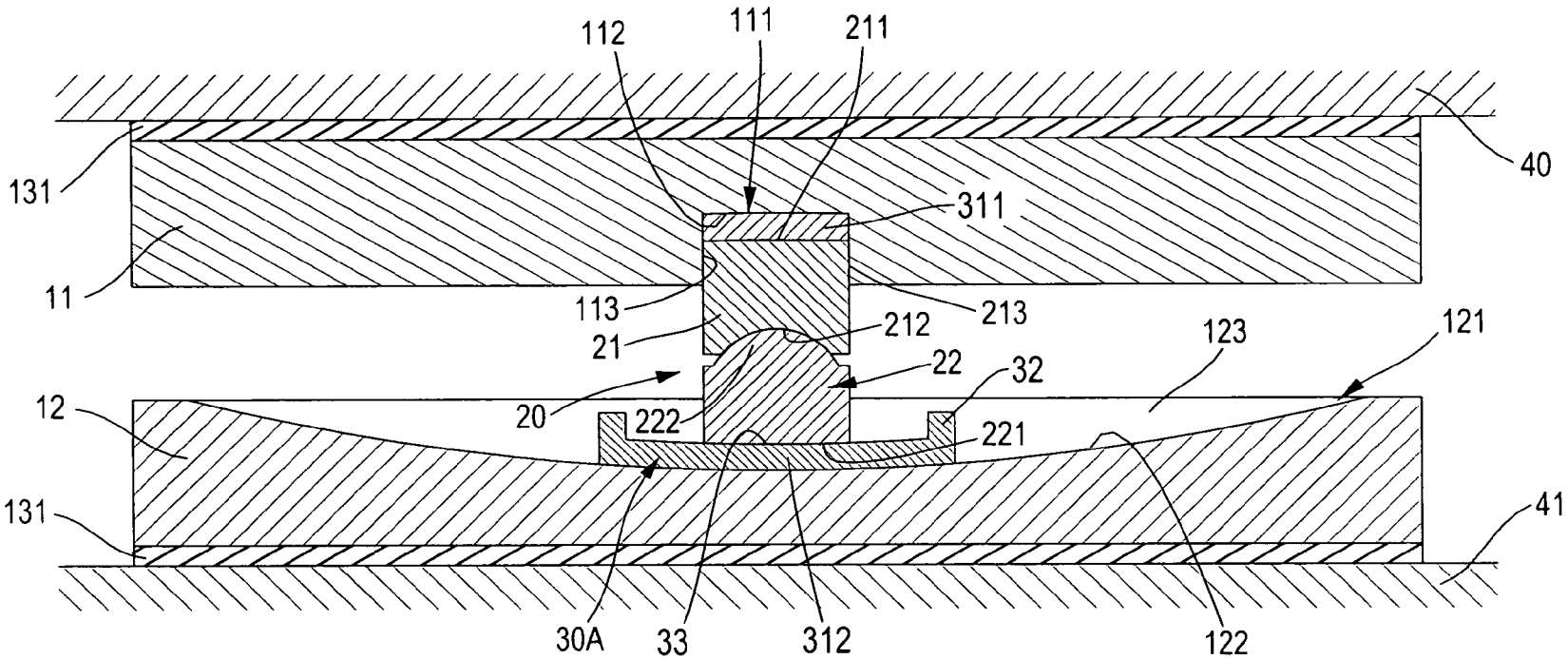
FIG. 7 is a cross sectional side view of the shock suppressor in FIG. 6.

With reference to FIGS. 6 and 7, a fifth embodiment of the shock suppressor has a structure substantially same as that in the first embodiment except that the sliding holder assembly (30A) comprises a first sliding holder (311) and a second sliding holder (312) mounted respectively in the first and second sliding channels (111,121) in the bases (11,12). The sliding holders (311,312) have the same structure and each comprise a convex bottom, a recess (33) with a concave bottom and two limiting flanges (32). The convex bottoms of the sliding holders (311,312) respectively abut and match with the concave surfaces (112,122) in the sliding channels (111,121). The convex end (211) of the first slider (21) abuts and matches with the concave bottom in the recess (33) of the first sliding holder (311). With the arrangement of the sliding holders (311,312) of the sliding holder assembly (30), the movement of the bases (11,12) to the original position is quick and stable.

Figure 8:
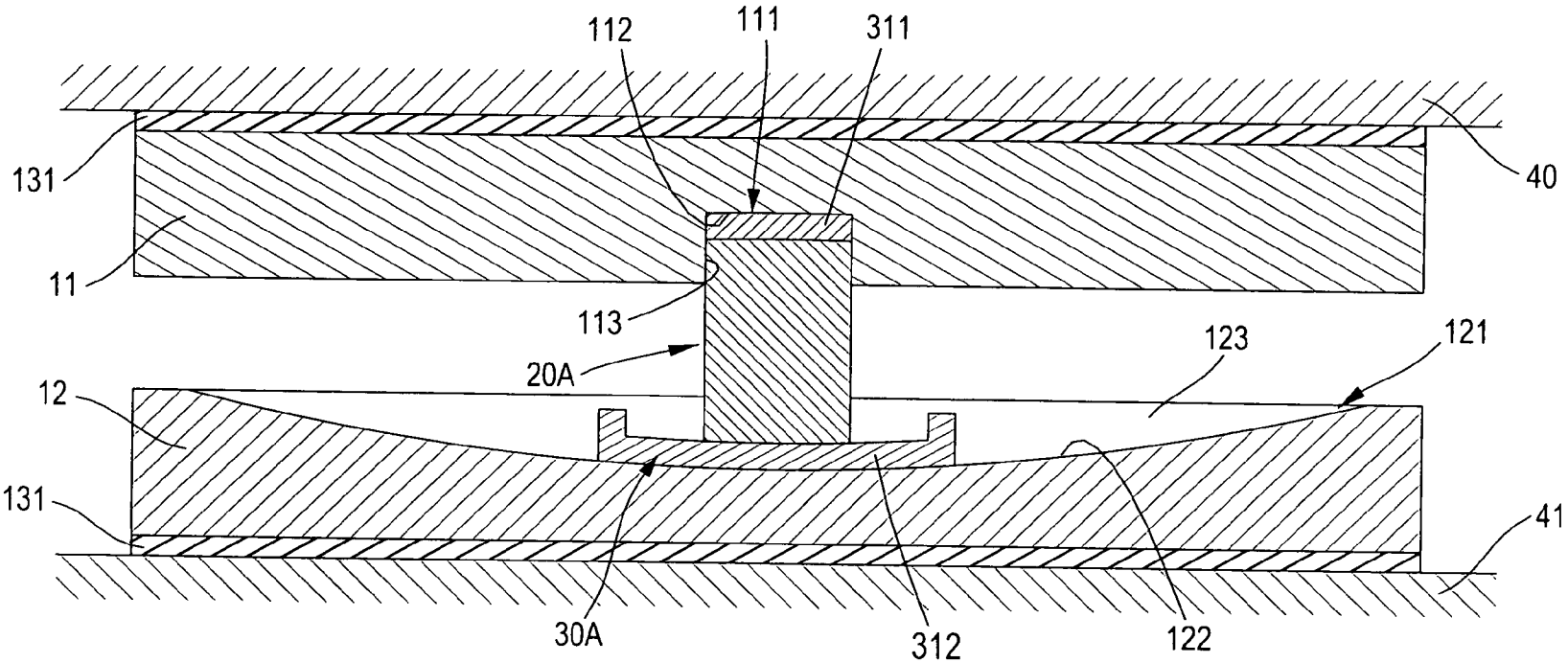
FIG. 8 is a cross sectional side view in partial cross section of a sixth embodiment of a shock suppressor in accordance with the present invention.

With reference to FIG. 8, a sixth embodiment of the shock suppressor has a structure substantially same as that in the fifth embodiment except that the connecting device (20A)

may be a rod having two convex ends abutting and matching respectively with the concave bottoms in the recesses (33) of the sliding holders (311,312).

Figure 9:
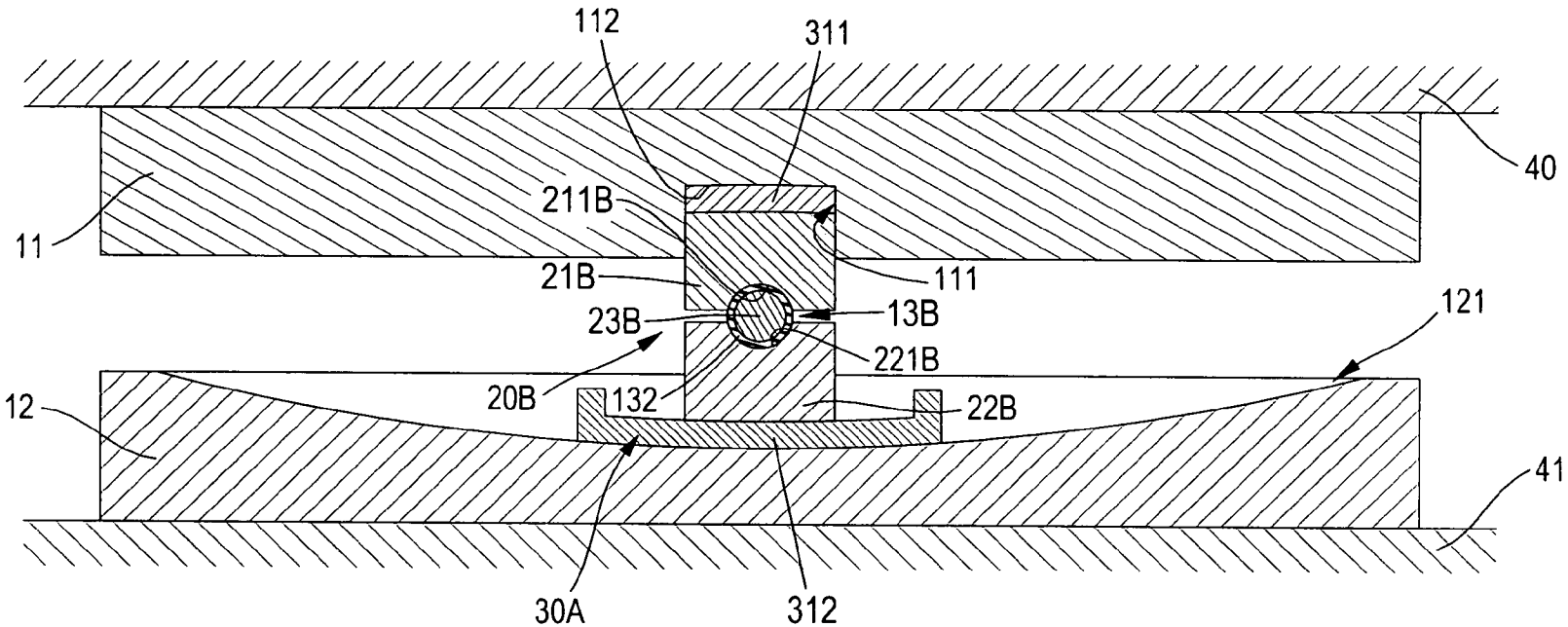
FIG. 9 is a cross sectional side view in partial cross section of a seventh embodiment of a shock suppressor in accordance with the present invention.

With reference to FIG. 9, a seventh embodiment of the shock suppressor has a structure substantially same as that in the fifth embodiment except that the universal connector of the connecting device (20B) comprises two recesses (211B, 221B) and a supporting member (23B) as described in the third embodiment shown in FIG. 4.

Figure 10:
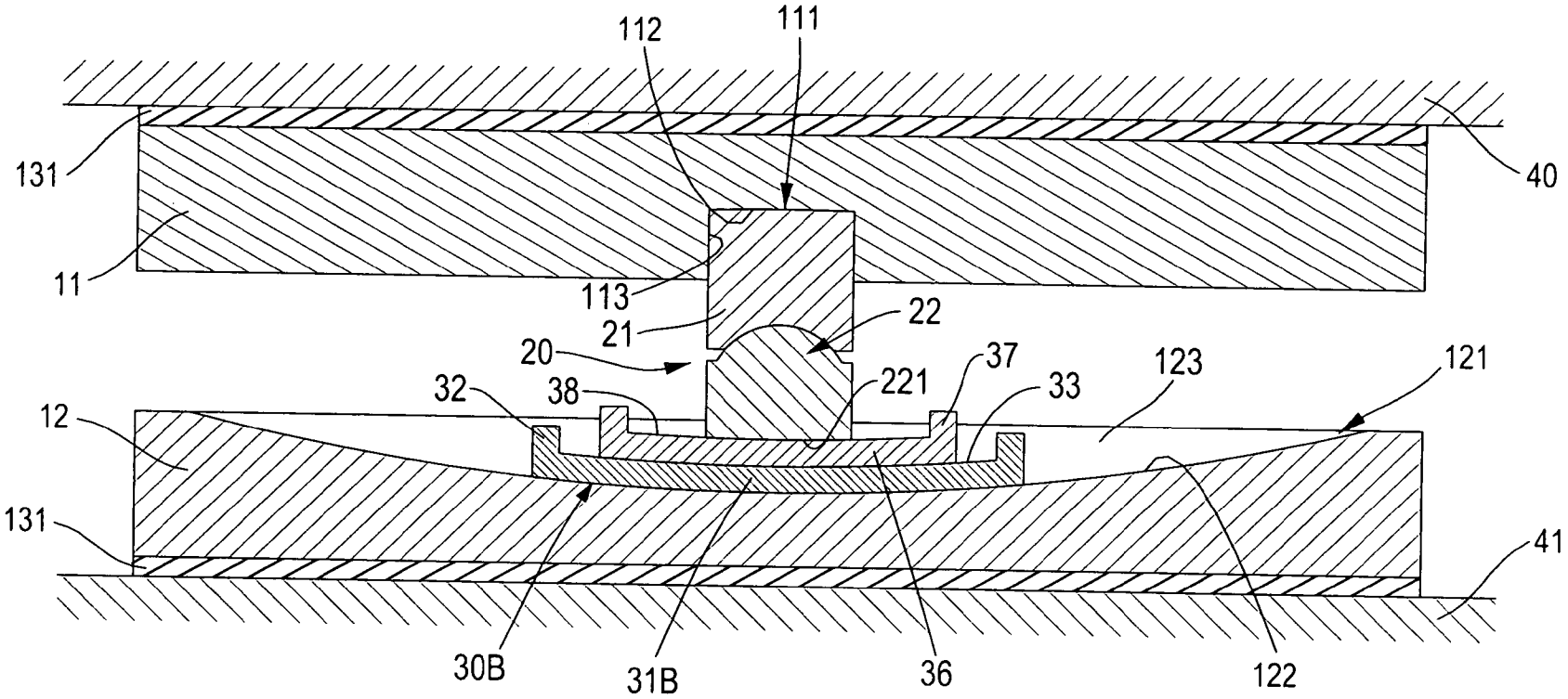
FIG. 10 is a cross sectional side view of an eighth embodiment of a shock suppressor in accordance with the present invention.
Figure 11:
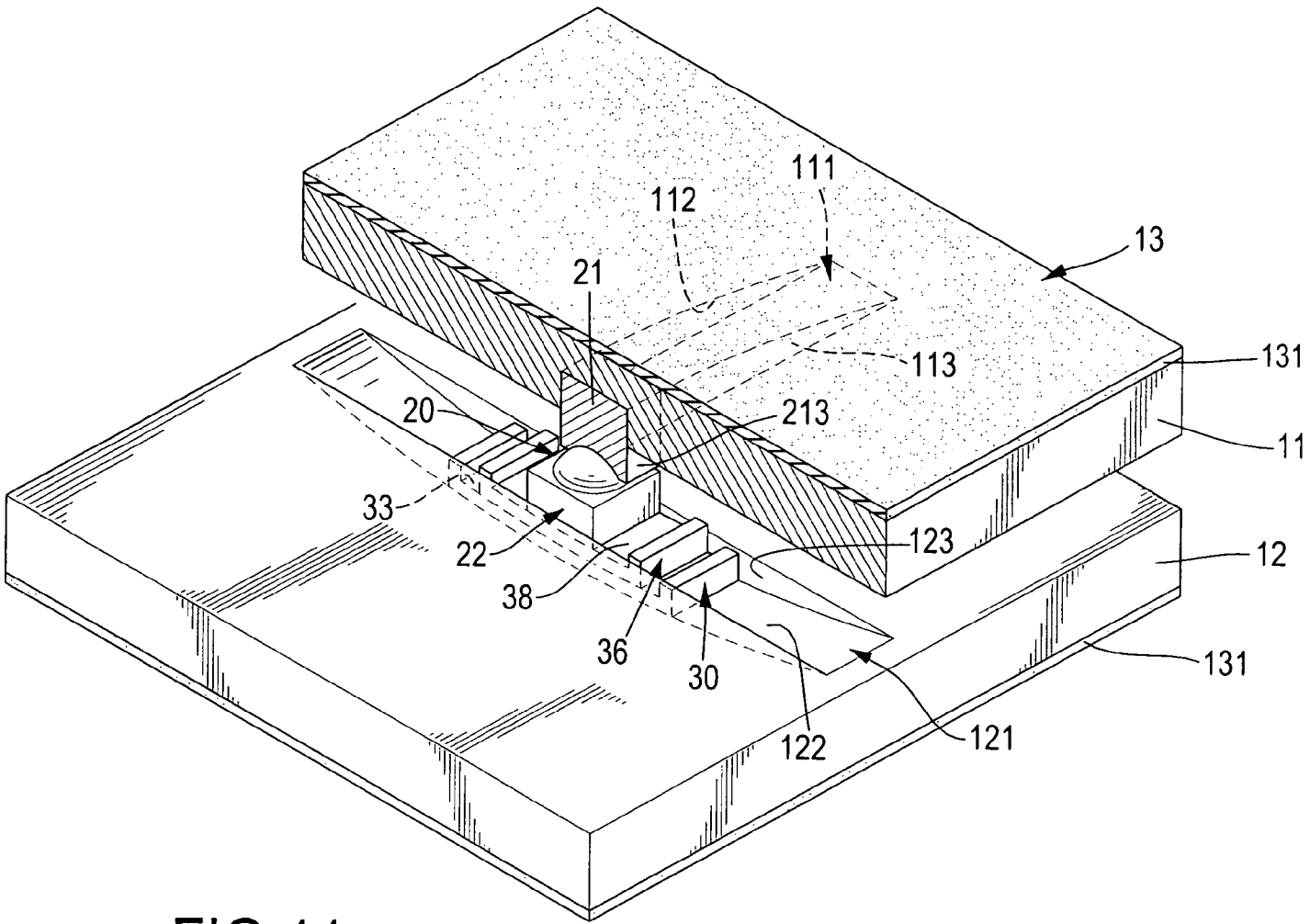
FIG. 11 is a perspective view in partial cross section of the shock suppressor in FIG. 10.

With reference to FIGS. 10 and 11, in an eighth embodiment of the shock suppressor the sliding holder assembly (30B) comprises a first sliding holder (31B) and a second sliding holder (36) mounted in the second sliding channel (121) in the second base (12). The sliding holders (31B,36) have similar structures but the second sliding holder (36) is smaller than the first sliding holder (31B). Each sliding holder (31B,36) comprise a convex bottom, a recess (33,38) with a concave bottom and two limiting flanges (32,37). The convex bottom of the first sliding holder (31B) abuts and matches with the concave surface (122) in the second sliding channel (121). The second sliding holder (36) is slidably held in the recess (33) in the first sliding holder (31B), and the convex bottom of the second sliding holder (36) abuts and matches with the concave bottom of the recess (33) in the first sliding holder (31B). The convex end (221) of the second slider (22) abuts and matches with the concave bottom in the recess (33) of the second sliding holder (36).

When a shock occurs, the sliding holders (31B,36) will slide along the second sliding channel (121) at the same time to isolate, dissipate or eliminate the shock energy. With the movement of the sliding holders (31B,36) in the same sliding channel (121), the travels of the sliding holders (31B,36) can be shortened and the sensitivity of the shock suppressor is improved.

Figure 12:
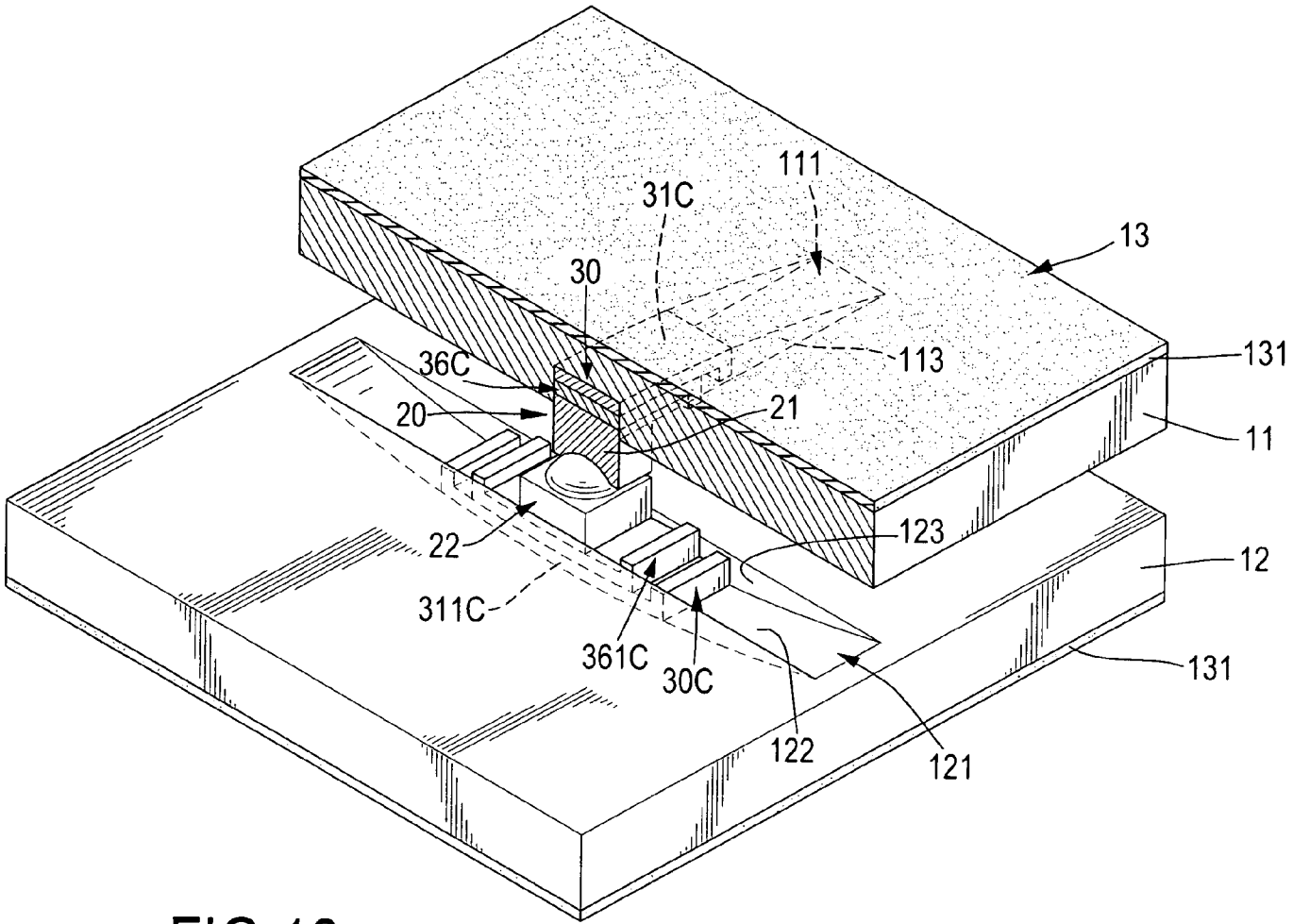
FIG. 12 is a perspective view in partial cross section of a ninth embodiment of a shock suppressor in accordance with the present invention.

With reference to FIG. 12, a ninth embodiment of the shock suppressor has a structure substantially same as that in the eighth embodiment except that the sliding holder assembly (30C) comprises a first holder assembly and a second holder assembly mounted respectively in the sliding channels (111, 121) in the bases (11,12). The first holder assembly comprises a first sliding holder (31C) and a second sliding holder (36C) mounted in the first sliding channel (111) in the first base (11). The second sliding holder (36C) is slidably held in the first sliding holder (31C) and has a structure similar to but smaller than that of the first sliding holder (31C). The second holder assembly comprises a third sliding holder (311C) and a fourth sliding holder (361C) mounted in the second sliding channel (121) in the second base (12). The fourth sliding holder (361C) is slidably held in the third sliding holder (311C) and has a structure similar to but smaller than that of the third sliding holder (311C).

When a shock occurs, the sliding holders (31C,311C,36C, 361C) will slide along the corresponding sliding channels (111,121) and each other, and the travels of the sliding holders (31C,311C,36C,361C) can be efficiently shortened. Additionally, each holder assembly may have three, four, five or more sliding holders dependent on the needs of use.

Figure 13:
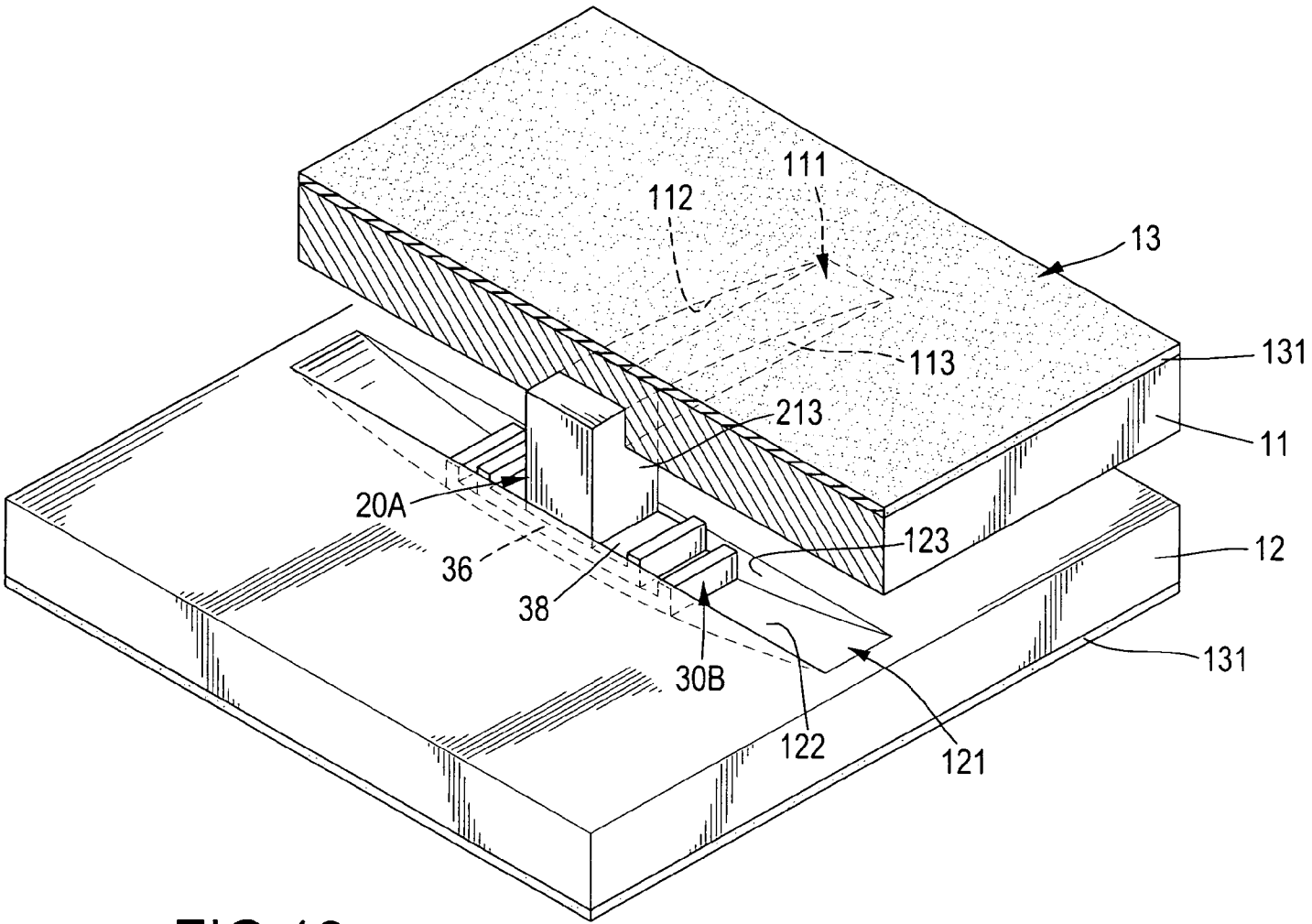
FIG. 13 is a perspective view in partial cross section of a tenth embodiment of a shock suppressor in accordance with the present invention.

With reference to FIG. 13, a tenth embodiment of the shock suppressor has a structure substantially same as that in the eighth embodiment except that the connecting device (20A) may be a rod having two convex ends abutting and matching respectively with the concave surface (112) in the first sliding channel (111) and the concave bottom in the recess (38) of the second sliding holder (36).

With such an arrangement, shock energy in multiple directions can be efficiently dissipated by the shock suppressor in accordance with the present invention. Additionally, with the sliding mechanisms in different unidirectional sliding directions, the displacement capacities and shock-isolating frequencies in different direction are different. Therefore, the shock suppressor can be applied to bridges or elongated building and is versatile in use.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A shock suppressor comprising:

a first base having an elongated first sliding channel in a first direction and the first sliding channel having a concave surface;

a second base being parallel to the first base and having an elongated second sliding channel defined in a side facing the first base in a second direction, and the second sliding channel having a concave surface facing the first base;

a connecting device slidably mounted between the first and second sliding channels in the first and second bases to connect the first and second bases and having two convex ends; and a sliding holder assembly mounted slidably between the connecting device and at least one of the bases and slidable relative to both of the connecting device and a corresponding base along the direction of the sliding channel in the corresponding base, wherein, the first base and the connecting device provide a first sliding mechanism in a first unidirectional sliding direction; and the second base and the connecting device provide a second sliding mechanism in a second unidirectional sliding direction perpendicular to the first unidirectional sliding direction.

2. The shock suppressor as claimed in claim 1, wherein the sliding holder assembly comprises a sliding holder slidably mounted in the second sliding channel in the second base and having a convex bottom abutting and matching with the concave surface of the second sliding channel in the second base; and a recess with a concave bottom being defined in the sliding holder at a side facing the first base to form two limiting flanges respectively at two ends of the sliding holder.

3. The shock suppressor as claimed in claim 2, wherein the connecting device comprises a first slider abutting the concave surface of the first channel in the first base and having a facing end facing to the second base;

a second slider abutting the concave bottom of the recess in the sliding holder and having a facing end facing to the first slider; and a universal connector is formed between the first slider and the second slider.

4. The shock suppressor as claimed in claim 3 further comprising a damping device mounted on at least one of the first base, the second base and the connecting device.

5. The shock suppressor as claimed in claim 3, wherein the universal connector comprises a recess defined in the facing end of the first slider; and a convex protrusion formed on the facing end of the second slider and rotatably held in the recess in the first slider.

6. The shock suppressor as claimed in claim 1, wherein the sliding holder assembly comprises a first sliding holder mounted in the second sliding channel in the second base and having a convex bottom abutting and matching with the concave surface of the second sliding channel in the second base; and a recess with a concave bottom being defined in the first sliding holder at a side facing the first base to form two limiting flanges respectively at two ends of the first sliding holder;

a second sliding holder mounted in the second sliding channel in the second base and the recess in the first sliding holder and having a convex bottom abutting and matching with the concave bottom of the recess in the first sliding holder; and a recess with a concave bottom being defined in the second sliding holder at a side facing the first base to form two limiting flanges respectively at two ends of the sliding holder; and one of the convex ends of the connecting device abuts and matches with the concave bottom in the recess of the second sliding holder.

7. The shock suppressor as claimed in claim 6, wherein the connecting device comprises a first slider abutting the concave surface of the first sliding channel in the first base and having a facing end facing to the second base;

a second slider abutting the concave bottom of the recess in the second sliding holder and having a facing end facing to the first slider; and a universal connector is formed between the first slider and the second slider.

8. The shock suppressor as claimed in claim 7 further comprising a damping device mounted on at least one of the first base, the second base and the connecting device.

9. The shock suppressor as claimed in claim 7, wherein the universal connector comprises a recess defined in the facing end of the first slider; and a convex protrusion formed on the facing end of the second slider and rotatably held in the recess in the first slider.

10. The shock suppressor as claimed in claim 1, wherein the sliding holder assembly comprises a first sliding holder slidably mounted in the first sliding channel in the first base and having a convex bottom abutting and matching with the concave surface of the first sliding channel in the first base; and a recess with a concave bottom being defined in the first sliding holder at a side facing the second base to form two limiting flanges respectively at two ends of the first sliding holder;

a second sliding holder mounted in the second sliding channel in the second base and having a convex bottom abutting and matching with the concave surface of the second sliding channel in the second base; and a recess with a concave bottom being defined in the second sliding holder at a side facing the first base to form two limiting flanges respectively at two ends of the second sliding holder; and the convex ends of the connecting device respectively abut and match with the concave bottoms in the recesses of the first and second sliding holders.

11. The shock suppressor as claimed in claim 10, wherein the connecting device comprises a first slider abutting the concave bottom of the recess in the first sliding holder and having a facing end facing to the second base;

a second slider abutting the concave bottom of the recess in the second sliding holder and having a facing end facing to the first slider; and a universal connector is formed between the first slider and the second slider.

12. The shock suppressor as claimed in claim 11 further comprising a damping device mounted on at least one of the first base, the second base and the connecting device.

13. The shock suppressor as claimed in claim 11, wherein the universal connector comprises a recess defined in the facing end of the first slider; and a convex protrusion formed on the facing end of the second slider and rotatably held in the recess in the first slider.

14. The shock suppressor as claimed in claim 1, wherein the sliding holder assembly comprises a first holder assembly and a second holder assembly mounted respectively in the first and second sliding channels in the first and second bases;

the first holder assembly is slidably mounted in the first sliding channel in the first base and comprises multiple sliding holder slidably abutting with each other;

the second holder assembly is slidably mounted in the second sliding channel in the second base and comprises multiple sliding holders slidably abutting with each other; and each sliding holder has a convex bottom; and a recess with a concave bottom being defined in the sliding holder to form two limiting flanges respectively at two ends of the sliding holder.

15. The shock suppressor as claimed in claim 14, wherein the connecting device comprises a first slider abutting the concave bottom of the recess in one of the sliding holders of the first holder assembly and having a facing end facing to the second base;

a second slider abutting the concave bottom of the recess in one of the sliding holders of the second holder assembly and having a facing end facing to the first slider; and a universal connector is formed between the first slider and the second slider.

16. The shock suppressor as claimed in claim 15 further comprising a damping device mounted on at least one of the first base, the second base and the connecting device.

17. The shock suppressor as claimed in claim 15, wherein the universal connector comprises a recess defined in the facing end of the first slider; and a convex protrusion formed on the facing end of the second slider and rotatably held in the recess in the first slider.

* * * * *